United States Patent [19]

Pellerin

[11] Patent Number: 4,593,481

[45] Date of Patent: Jun. 10, 1986

[54] TUMBLE DRYER

[75] Inventor: Norvin L. Pellerin, New Orleans, La.

[73] Assignee: Pellerin Milnor Corporation, Kenner, La.

[21] Appl. No.: 709,224

[22] Filed: Mar. 7, 1985

[51] Int. Cl.[4] ..... F26B 11/04

[52] U.S. Cl. ..... 34/133; 34/134; 34/137

[58] Field of Search ..... 34/109, 133, 134, 136, 34/137, 139

[56] References Cited

U.S. PATENT DOCUMENTS

| | | | |
|---|---|---|---|
| 1,544,884 | 7/1925 | Braley | 34/109 |
| 3,995,988 | 12/1976 | Freze | 34/133 |
| 4,015,930 | 4/1977 | Gratham | 34/136 |
| 4,296,072 | 10/1981 | Takacs et al. | 34/133 |

FOREIGN PATENT DOCUMENTS

| | | | |
|---|---|---|---|
| 504967 | 8/1930 | Fed. Rep. of Germany | 34/109 |

*Primary Examiner*—Albert J. Makay
*Assistant Examiner*—David W. Westphal
*Attorney, Agent, or Firm*—Vaden, Eickenroht, Thompson & Jamison

[57] ABSTRACT

There is disclosed a tumble dryer wherein the drum in which the goods are to be tumbled has perforations formed in its cylindrical wall at opposite sides of an imperforate annular portion, and a means is proved for circulating heated air into the drum through the perforations on one side of the annular portion, and then axially through the drum and thus the goods, and then radially out of the drum through the perforations on the other side of the imperforate annular portion. Melted plastic articles which may be co-mingled in the batch of goods to be dried are collected on a heat sink which comprises strips including a metal body of high thermal capacity and heat conductivity removably secured to the inner surface of the annular imperforate portion of the drum.

6 Claims, 6 Drawing Figures

TUMBLE DRYER

This invention relates to so called tumble dryers wherein heated air is circulated through cloth goods or the like as they are "tumbled" within a drum which is rotated within a housing about a generally horizontally disposed axis. More particularly, it relates to improvements in tumble dryers of the type wherein, as disclosed in co-pending application, Ser. No. 656,767, filed Oct. 1, 1984, entitled "Apparatus for Treating Cloth Goods", and assigned to the Assignee of the present application, the heated air is caused to pass radially into the drum through perforations in a cylindrical surface of the drum to one side of an imperforate annular portion of the cylindrical surface, then axially of the drum and thus through the goods, and then radially out of the drum through perforations in the cylindrical surface to the other side of the annular imperforate portion.

As explained in the aforementioned co-pending application, the imperforate annular portion of the drum serves as a heat sink so that many plastic articles co-mingled with the goods, such as bags, utensils of the like, will melt and adhere to the annular imperforate portion, and thus not clog the perforations, and thereby restrict air flow, as occurs in the drums of tumble dryers of conventional construction. This thereby minimizes downtime of the dryer for repair, and, during repair, permits removal of the melted plastic from the drum with relative ease, as compared with removing it from within the perforations themselves.

As shown in the aforementioned co-pending application, the space between the drum and the housing in which it rotates is separated into inlet and outlet portions connecting with the perforations on opposite sides of the imperforate annular portion so as to require substantially all of the heated air passing from one space portion to another to circulate through the goods. More particularly, the space is divided by a wall which carries a ring closely surrounding the imperforate annular portion of the drum as it rotates therein so that annular imperforate portion not only acts as a heat sink, but also provides a smooth surface which minimizes wear on the ring during drum rotation.

Since drums of this type are ordinarily made of thin gauge sheet metal, the thermal capacity of the heat sink is inherently limited. Furthermore, even though the melted plastic is more easily removed than from within the perforations, substantial time and expense is still required to remove it from the imperforate annular portion of the drum. On the other hand, it would be quite costly and wasteful, from an overall standpoint, to make the entire drum from thicker metal and/or of a metal having metallurgical characteristics more conducive to its heat sink function, or a metal from which the melted plastic is more easily removable. Furthermore, the drum and thus the entire dryer must be taken out of service while the melted plastic is removed from the heat sink.

It is therefore the object of this invention to provide a dryer having a drum of the type above described which may also be made of thin gauge metal best suited for its primary function, but which has a heat sink of greater thermal capacity for collecting melted plastic thereon, and from which the melted plastic may be removed with less downtime of the dryer and with less difficulty and expense.

This and other objects are accomplished, in accordance with the illustrated embodiment of this invention, by means of a dryer having a drum of the type described in the aforementioned copending application and provided with a heat sink comprised of strips removably secured to and about the inner surface of the annular imperforate portion of the drum, each such strip including a metal body of relatively high thermal capacity and heat conductivity. This not only enables more melted plastic to be collected on the heat sink, without altering the basic construction of the drum, but also requires that the dryer be out of service for only the time required to replace one or more of the strips with additional strips which may be stocked for that purpose. Thus, the melted plastic may be removed from the just removed strips as the dryer is put back into service, whereby they are made ready for use when other strips require replacement.

In the illustrated embodiment of the invention, wherein the drum has ribs extending longitudinally along its inner surface, as is conventional in this type of dryer, the strips extend substantially from one rib to the next. Preferably, the exposed surfaces of the metal bodies of the strips are covered with a material, such as Teflon, from which the melted plastic may be easily removed.

In the illustrated embodiment of the invention, as in the dryer of the aforementioned copending application, the space between the drum and housing is divided into separate portions, to require that substantially all of the heated air pass through the drum from the inlet to the outlet portion, by a wall having a ring carried thereby and closely surrounding the imperforate portion of the drum as the drum rotates within the housing, thereby minimizing wear on the ring during rotation of the drum.

In the drawings, wherein like reference characters are used throughout to designate like parts:

Figure 2:
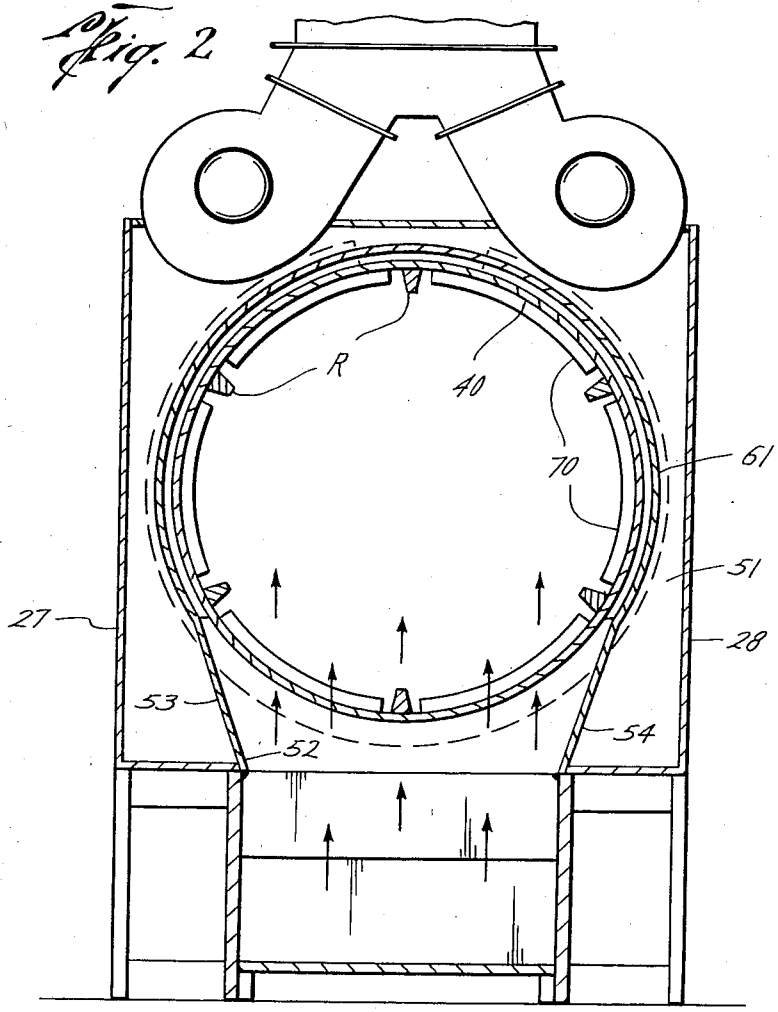
FIG. 2 is a vertical view of the dryer, as seen along broken line 2—2 of FIG. 1, and having arrows showing the direction of heated air flow through the inlet into the one space portion about the drum and then into the drum.
Figure 1:
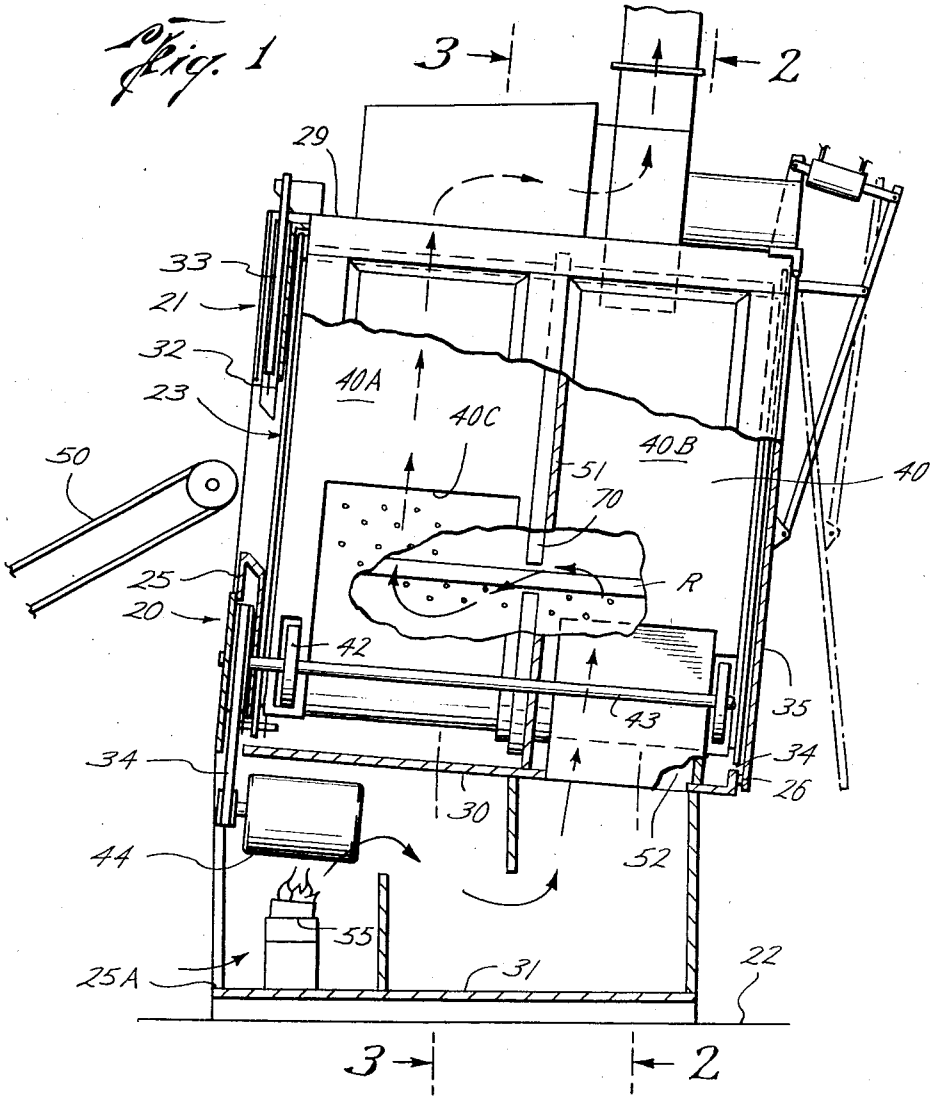
FIG. 1 is a view, partly in side elevation and partly in vertical cross section, of a dryer constructed in accordance with the present invention, and having arrows showing the path of heated air through the dryer.
Figure 3:
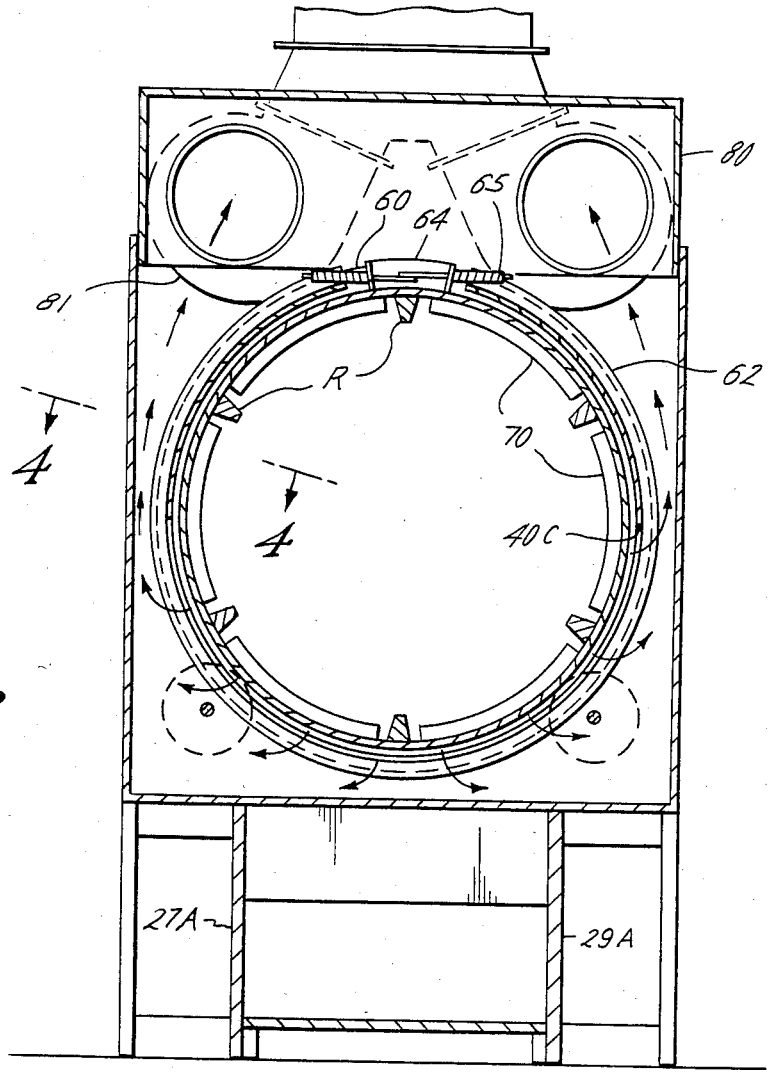
FIG. 3 is a vertical sectional view of the dryer, as seen along broken lines 3—3 of FIG. 1, and having arrows showing the direction of heated air flow from the drum into the other space portion and then into the outlet.
Figure 4:
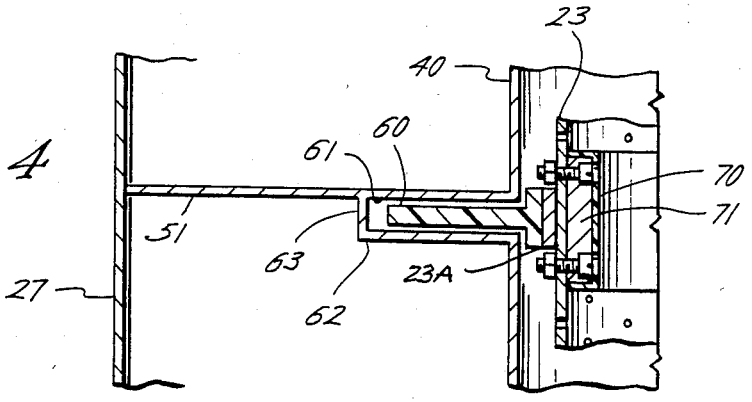
FIG. 4 is an enlarged sectional view of a portion of the housing and drum, as seen along broken lines 4—4 of FIG. 3, and showing the ring which surrounds the drum received in an annular recess of the wall which separates the space between the drum and housing intermediate their opposite ends.
Figure 5:
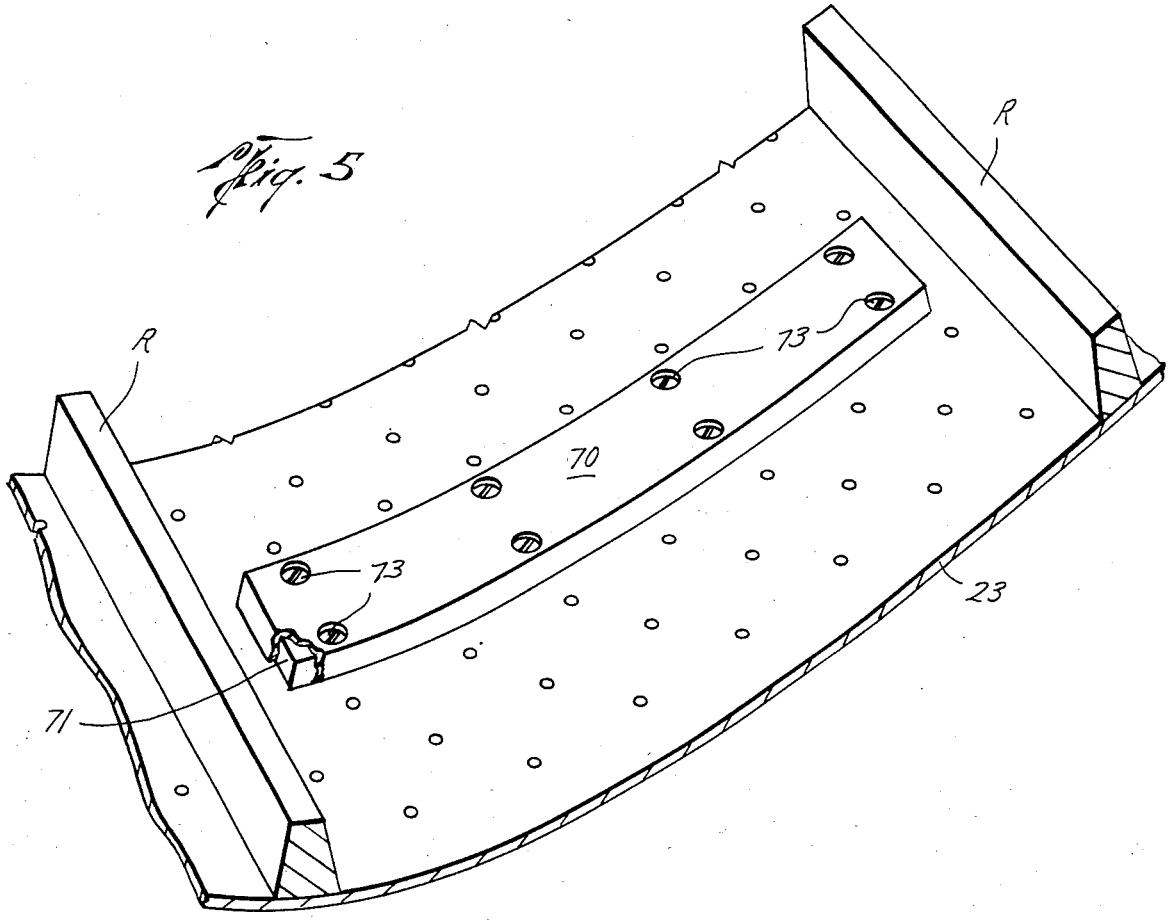
FIG. 5 is an enlarged perspective view of a portion of the inner side of the drum and a heat sink strip secured thereto.

With reference now to the details of the above-described drawings, and particularly FIGS. 1 to 3, the overall dryer, which is indicated in its entirety by reference character 20, is like that shown and described in the aforementioned copending application in that it includes a housing 21 supported above a surface 22, and an open-ended drum 23 mounted within the housing for rotation with respect thereto about a generally horizontal axis. More particularly, the housing 21 includes an outer portion having front and rear walls 25 and 26, side walls 27 and 28, and top and bottom walls 29 and 30. The bottom wall of the outer housing is supported above the surface 22 by a base having a bottom wall 31, side walls 27A and 29A, an open front end 25A and a rear wall 26A, whose lower ends support wall 31 above the surface 22.

The top and bottom walls 29 and 30 of the upper housing portion are inclined at a small angle with respect to the horizontal, and drum 23 is mounted within the upper housing portion for rotation about an axis which extends at the same angle. The front wall 25 of the outer housing has an opening 32 opposite the open upper end of the drum, and the rear wall 26 of the outer housing has an opening 34 opposite the open lower end of the drum. The opening 32 and thus the upper end of the drum are adapted to be covered and uncovered by means of a reciprocable door 33, and the opening 34 and thus the lower end of the drum are adapted to be opened and closed by means of a door 35 pivotally mounted on the housing. Thus, wet goods on a conveyor 50 may be loaded into the drum through opening 32 when door 33 is open, and may be unloaded therefrom through opening 34 when door 35 is open. Both doors are of course closed as the drum is rotated to tumble dry the goods.

The drum 23 extends from one end to the other of the housing to dispose its opposite ends adjacent the front and rear walls, and is supported within and rotated with respect to the housing by means of rollers 42 near each end and opposite sides of the lower half of the drum. These rollers are mounted on shafts 43 which extend lengthwise of the drum and have their opposite ends journaled in the front and rear walls 25 and 26 of the housing. At least one of the shafts is driven by means of an electric motor 44 mounted beneath the wall 30 of the housing and outside of the wall 28A and connected by a belt 34 to a sheave on one end of the shaft, as shown in FIG. 1.

The housing 21 includes an inner portion having a shell 40 which extends for the length of the drum intermediate its flanges 46, and which includes arcuate sections 40A and 40B disposed in spaced-apart relation about the upper and lower ends, respectively, of the drum. A duct 52 connects a hole in the bottom wall of the outer housing with an opening in the bottom of arcuate portion 40B to form an inlet to the space about the drum, and an opening 40C in the bottom of arcuate portion 40A forms an outlet from the space about the drum.

The inner housing portion also includes a transverse wall 51 which extends between shell 40 intermediate portions 40A and 40B and the side walls 27 and 28 and the top and bottom walls 29 and 30 of the housing to separate the space within the housing and about the drum into portions on both sides of the wall, and the outer portion of a ring 60 of Teflon or other low friction material having an inner diameter which closely surrounds an imperforate annular portion 23A of the drum is mounted closely within an annular recess 61 formed about the inner portion of the shell adjacent the wall 51 intermediate the inlet to and outlet from the space. More particularly, the cylindrical wall of the drum is perforated on both sides of the imperforate portion 23A, and then ring 60, so that, when the ends of the drum are closed during rotation, the close confinement of the ring within the recess will substantially seal between the drum and wall to substantially confine hot air entering inlet 52 to flow through the perforations into the drum to the right of ring 60 and axially through the drum and out the perforations in the drum to the left of the ring into outlet 40C.

As shown in FIGS. 2 and 3, the wall 62 is interrupted adjacent the upper side of the drum to receive a bracket 64 which connects the ends of the ring 60 to one another and is mounted on the wall 51 of the inner housing. As described in the aforementioned copending application, the ends of the ring overlap and are yieldably urged toward one another by springs 65 to hold the ring tightly about the drum 23. Thus, although the drum 23 must be free to rotate within the ring 60, the ring is nevertheless sufficiently tight about the drum that substantially all the heated air pass must move axially through the drum. As also previously noted, the engagement of ring 60 with the imperforate portion 23A of the drum reduces wear.

As best shown in FIGS. 1, 7 and 8, the duct 52 is formed by side walls 53 and end walls 54 extending downwardly from an opening in the bottom of the arcuate portion 40B to the opening in bottom wall 30. The left-hand rollers 42 extend through slots in shell portion 40A and into the upper space portion to support the upper end of the drum, and the right-hand rollers extend through slots in shell portion 40A and into the lower space portion to support the lower end of the drum.

A gas burner 55 is mounted on bottom wall 31 of the base of the housing adjacent its open left end 25A, whereby fresh air is heated before passing through the duct in the base and into the inlet 52, and thus into the lower space fresh air is heated before passing through the duct in the base and into the inlet 52, and thus into the lower space portion between the drum and the shell of the inner housing on the right side of ring 60.

Openings are formed in the top wall 29 of the outer housing above the shell portion 40A about the upper end of the drum to the left of wall 51 so as to connect with plenums 70 mounted on the top wall and connecting at their right-hand ends with suction blowers 71 also mounted on the top wall 29 toward the rear end of the housing. As indicated by the arrows, heated air is caused to circulate from within the drum and through its perforations into the upper space portion to the left of ring 60. More particularly, and as will best be understood from FIGS. 1 and 3, heated air in the upper space portion must pass through the outlet 40C therefrom and then over the top of the arcuate portion 40A to the left of wall 51 before entering the openings leading to the air blower plenum. In this way, goods are prevented from collecting in the upper portion of the left-hand end of the drum, and thus restricting air flow, before circulating into the outlet from the space portion.

The inclination of the drum with respect to the horizontal may be in the order of 7.5 degrees, and, in any case, is so selected as to cause wet goods to slide downwardly to its lower end, but to permit dried goods to settle uniformly over the bottom of the drum under the influence of the heated air passing axially therethrough.

Reviewing now the overall operation of the dryer, as thus far described, door 33 is opened and door 35 closed to permit wet clothes or other cloth-goods to be dried to be loaded into the dryer by means of the conveyor 50. Upon closing of the door 33, the drum may be rotated to tumble the goods therein and, for this purpose, there are longitudinal ribs on the inner diameter of the cylindrical wall of the drum. At the same time, the air blower is started so as to cause fresh air to be drawn over the gas burner and thereby heated as it passes through the inlet and the lower space portion into the drum, and then axially through the drum and out the perforations to the left of the ring 60 into the upper space portion, and from there out of the dryer through the air blower. As the drum is so rotated by means of the rollers 42, the goods will gravitate toward the lower right-hand end of the drum, and thus to a position for the heated air to pass through them as it first enters the upper housing portion. As the hot air leaves the upper end of the drum, it must pass beneath the upper edges of outlet 40A before passing into the air blower. When the goods are sufficiently dry, rotation of the drum is stopped, the gas burner extinguished, and door 35 opened to permit the dried goods to be unloaded through the lower end of the drum. As previously mentioned, the inclination of the drum will facilitate unloading through the opening in its right-hand end.

As also previously described, plastic articles which may be co-mingled with the cloth goods to be dried, and which would be melted by the heat within the dryer, are collected on a heat sink made-up of strips 70 removably secured to the inner surface of imperforate annular portion 23A of the drum. More particularly, these strips extend substantially between adjacent ribs R which extend longitudinally of the drum in order to promote tumbling action, and thus for a major portion of the inner circumference of the drum. As previously described, the strips include a metal body 71 of high thermal capacity and heat conductivity. In the interest of reducing costs to a minimum, the strips may be made of cast aluminum, and of a size which will depend upon the thermal capacity required. Alternatively, the strips may be made of brass, copper, stainless steel, or other metal having high thermal capacity and high thermal conductivity.

Figure 6:
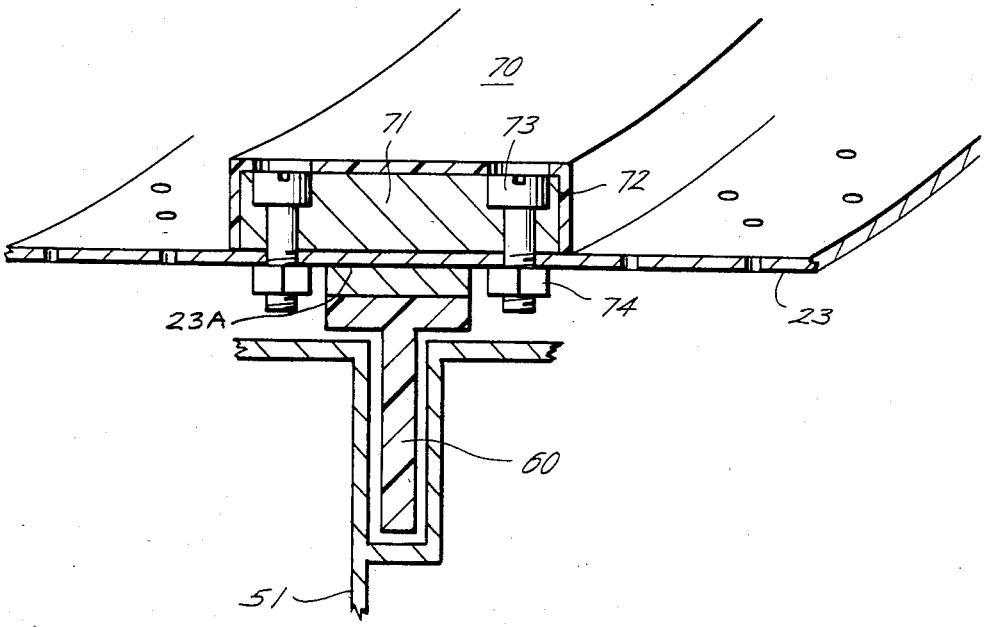
FIG. 6 is an enlarged cross sectional view of the strip and drum shown in FIG. 5.

As also previously described, at least the exposed surfaces of the metal body of each strip are covered with a layer 72 of Teflon or other material from which the melted plastic may be easily removed. As shown, the strips are curved to fit closely against the imperforate annular portion, and are removably secured thereto by means of threaded bolts 73 extending through aligned holes in the strip and the imperforate annular portion of the drum and held. As shown, in FIG. 6, the enlarged upper ends of the bolts are received within counterbores in the upper ends of the holes in the strip, and are held tightly down upon the metal body strip by the make-up of nuts 74 over the lower ends of the bolts. As also shown in FIG. 6, these nuts are disposed on opposite ends of the ring 60 which closely surrounds the imperforate annular portion.

As also previously described, when melted plastic has been collected on the strips to the extent that it interferes with continued collection, or to the extent that it interferes with tumbling of the cloth goods within the drum, the dryer is shut-down only for such time as is necessary to remove the affected strips and replace them with other strips. The dryer may then continue to be operated as the melted plastic is removed from the strips to prepare them for replacement purposes. Thus, users of the dryer may be provided with extra strips for this purpose.

As also previously described, the drum itself may be made from thin gauge metal suitable for the basic tumbling purposes of the dryer. That is, the desired thermal capacity of the heat sink is supplied by the strips, rather than the drum itself.

From the foregoing it will be seen that this invention is one well adapted to attain all of the ends and objects hereinabove set forth, together with other advantages that are obvious and that are inherent to the method and apparatus.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth or shown in the accompanying drawings is to be interpreted as illustrative and not in a limiting sense.

What is claimed is:

1. A tumble dryer, comprising a drum to receive cloth goods to be dried and mounted for rotation about a generally horizontal axis, said drum having a cylindrical surface which is perforated on opposite sides of an annular imperforate portion, means for circulating heated air through the goods including means for causing the air to pass radially into the drum through perforations on one side of the imperforate portion, axially within the drum, and then radially out of the drum through perforations on the other side of the imperforate portion, and a heat sink on which melted plastic articles in a batch of the goods may be collected, comprising relatively thin strips removably secured to the inner surface of the annular portion, each strip including a metal body of high thermal capacity and heat conductivity as compared with the material from which the annular portion is made.

2. A dryer of the character defined in claim 1, wherein the exposed surfaces of the metal bodies are covered with a material from which the melted articles may be easily removed.

3. A dryer of the character defined in claim 1, wherein the drum has ribs which extend generally axially along its inner surface, and the strips extend substantially between adjacent ribs.

4. A tumble dryer, comprising a housing, a drum mounted within the housing for rotation about a generally horizontal axis and having perforations therein on opposite sides of an imperforate annular portion, means including a ring which surrounds the imperforate annular portion of the drum, during rotation of the drum, to separate the space between the housing and the drum into one portion which connects with the perforations on one side of the imperforate portion and another space portion connecting the perforations on the other side of the imperforate portion, said housing having an air inlet to the one space portion and an air outlet from the other space portion, means for circulating heated air from the inlet through one space portion and radially into the drum through the perforations on said one side of the drum, then axially of the drum, and then radially out of the drum through the perforations on the other side thereof and the other space portion to the outlet, and a heat sink on which melted plastic articles in a batch of the goods may be collected, comprising relatively thin strips removably secured to the inner surface of the annular portion, each strip including a metal body of high thermal capacity and heat conductivity as compared with the material from which the annular portion is made.

5. A dryer of the character defined in claim 4, wherein the exposed surfaces of the metal bodies are covered with a material from which the melted articles may be easily removed.

6. A dryer of the character defined in claim 4, wherein the drum has ribs which extend generally axially along its inner surface, and the strips extend substantially between adjacent between adjacent ribs.

* * * * *